United States Patent [19]

Amann

[11] Patent Number: 4,852,212

[45] Date of Patent: Aug. 1, 1989

[54] SET OF HARDWARE FOR MOUNTING A HINGED AND SLIDABLE DOOR ON A BOX UNIT OF FURNITURE

[75] Inventor: Reinhard Amann, Lustenau, Austria

[73] Assignee: Alfit Gesellschaft m.b.H., Götzis, Austria

[21] Appl. No.: 104,803

[22] Filed: Oct. 2, 1987

[30] Foreign Application Priority Data

Oct. 16, 1986 [AT] Austria ..... 2750/86

[51] Int. Cl.[4] ..... A47H 15/00; A47B 88/00

[52] U.S. Cl. ..... 16/102; 312/322

[58] Field of Search ..... 16/102, 82, 89; 49/404; 312/322, 323

[56] References Cited

U.S. PATENT DOCUMENTS

| | | | |
|---|---|---|---|
| 621,059 | 3/1899 | Fuller | 312/323 X |
| 827,292 | 7/1906 | Burtch | 312/322 X |
| 2,453,049 | 11/1948 | Triller | 16/82 |
| 2,807,835 | 10/1957 | Weise | 312/322 X |
| 2,936,206 | 5/1960 | Wilmer et al. | 312/322 |
| 3,017,233 | 1/1962 | Gates | 312/322 |

*Primary Examiner*—Nicholas P. Godici
*Assistant Examiner*—Carmine Cuda
*Attorney, Agent, or Firm*—Kurt Kelman

[57] ABSTRACT

A set of hardware for mounting a hinged and slidable door (5) on a box unit of furniture (1 to 4) comprises hardware elements (8, 9, 18, 19, 20, 23, 25), which define a pivotal axis for mounting the door (5) and comprise slide track devices which are adapted to be mounted to extend parallel to the pivotal axis and to a wall (1) of the box and to guide the door (5) into the box when the door has been swung open. To permit a substantial use of commercially available, simple components and a simple adaptation of the hardware elements to doors differing in size, the slide track devices comprise two track rails (8, 9), which are adapted to be mounted so as to be spaced apart and to extend horizontally. A trolley (19, 20) is associàted with each of the track rails and comprises rollers guided on bearing surfaces of the guide rails. The trolleys (19, 20) are adapted to be interconnected by a mounting plate (23) on that side of the rails which faces away from the wall (1) of the box. The door (5) is hinged to the mounting plate (23) by furniture hinges (25). Carriage stop devices (11, 15) are provided for limiting the movement of the carriages (19, 20) along the rails (8, 9). Adjustable door stop devices (26, 27) are provided for cooperation with the door (5) in its closed position at those edges of the door which extend from the edge at which the furniture hinges (25) are provided.

7 Claims, 3 Drawing Sheets

SET OF HARDWARE FOR MOUNTING A HINGED AND SLIDABLE DOOR ON A BOX UNIT OF FURNITURE

BACKGROUND OF THE INVENTION

1. Field of the Invention

This invention relates to a set of hardware for mounting a hinged and slidable door on a box unit of furniture. The hardware comprises means for defining a pivotal axis for the door, and slide track means, which are parallel to said pivotal axis and to a wall, which is transverse to the opening that is to be closed by the door. Said slide track means are adapted to guide the door in the direction of its main plane into the box after the door has been swung open out of the box.

2. Description of the Prior Art

By means of hinged and slidable doors, an open side of a box can be almost entirely exposed and such a door can be pushed into the box without a need for a substantial lateral space and without the door extending over or under other visible portions of the box. Those hinged and slidable doors which are known as "flipper doors" are used, e.g., for built-in furniture for accommodating television or audio appliances. It is also known to use two-wing doors, which open to opposite sides, or to provide low-depth boxes with a single door leaf, which consists of two hinged elements which can be folded together like a folding door.

The parts of such furniture have previously been assembled by means of separately manufactured fittings and track elements, elements which are expensive and cannot easily be adapted to doors of different heights and width and to the space which is available in the associated compartment of the box.

SUMMARY OF THE INVENTION

It is an object of the invention to provide a set of hardware which is of the kind described first hereinbefore and which consists in a large part of commercially available elements, which have previously been used for different purposes, and which permit of an adaptation to different conditions of installation, ensures a pleasing appearance and an adequate strength of the assembled furniture and permits the mounted door to be adjusted and re-adjusted so as to ensure an exact closed position.

The object set forth is accomplished in that the slide track means comprise two track rails, which are adapted to be mounted on spaced apart parallel horizontal edges of a box wall, and two carriages, which are supported on respective ones of said track rails and each of which comprises at least two rollers, which are guided on two bearing surfaces of the associated track rail, a mounting plate is provided for interconnecting said two carriages on that side which faces away from the box wall, furniture hinges are provided for hingedly mounting the door on said mounting plate, carriage stops are provided for limiting the movement of the carriages along the track rails, and adjustable door stops are provided, which when the door is closed are adapted to cooperate with those edges of the door which extend from the edge at which the furniture hinges are connected to the door.

The track rails preferably consist of so-called corpus rails, such as are used in telescopic guides for extensible furniture elements, such as drawers. Such rails can be cut in the required lengths from continuous bar stock and can additionally be processed by being punched and embossed and by end bending and the like operations.

The rollers used may be of the type used in telescopic guides. The load-carrying parts of the carriages may substantially consist of parts which are commercially available or can easily be made.

Carrier plates may be made from a material which matches the respective unit of furniture. The width of the carriages and mounting plates will depend on the space which is available (when the door has been swung open the mounting plate and the door lie one behind the other along the side wall) and on the largest span which is consistent with the stability requirements. Carriages may be provided which have rollers only at their ends, as well as carriages having more than two rollers.

Commercially available furniture hinges are preferred, particularly furniture hinges which can be adjusted and readjusted in three dimensions, so that the door can be mounted on the carrying plate just as a hinged door can be mounted on a side wall. Finally, the stops which are provided can be used to limit the extent to which the carriages can be extended. The door stops for cooperation with the door will define the closed position and will ensure that the mounting plate will be in the correct end position when the door is closed. The stops will also prevent an undesired turning of the door into a rabbetless opening of the box.

In a preferred embodiment, the track rails are adapted to be mounted along the edges of a box wall, the carriages are provided with brackets, which are bent out to the side which faces away from the rollers and serve to mount the mounting plate, and adjustable furniture hinges are provided, which permit the door to be swung open to a position in alignment with the mounting plate.

The above-mentioned mounting of the track rails will result in an additional support of said rails on the adjacent walls of the unit of furniture and will facilitate the assembly. The parts which have been mentioned hardly disturb the overall appearance.

Particularly for use with doors which are hinged on vertical axes, a preferred embodiment comprises end stops for the rollers, which end stops are fitted into the track rails at those ends which are near the box opening that is to be closed by the door. Said end stops consist of yieldable material, particularly plastic, and carry guards or guides for cooperation with the doors, which guards or guides protrude transversely over the rail and prevent a scratching of the door as it is pushed in and opened. Alternatively, it is possible to use furniture hinges which have a brake or detent position so that they will prevent a fluttering of the door. Such a fluttering of the door in its open position may alternatively be limited or prevented by stops, which are mounted in the box and cooperate with the inside surface of the door when it is open.

In order to permit an exact adjustment of the closed door so that it will be aligned with the edges of the corpus or will protrude therefrom exactly to a predetermined extent, the stops for cooperating with the closed door may consist of eccentrics, which are adapted to be secured to the walls of the box or of the other furniture corpus on the surfaces facing the opening and which are adjustable and adapted to be fixed in position and particularly consist of elastically yieldable material.

A set of hardware in accordance with the invention can obviously be used also for hinged and sliding doors which in an open position can be pushed only in part into the interior of the furniture corpus.

For use with doors which can be swung open to the top and exceptional cases to the bottom of the unit of furniture, a particularly space-saving structure can be obtained in that the track rails are adapted to be attached to the top or bottom of the unit for furniture and said track rails comprise trough flanges, which receive the rims of the rollers, which are rotatable about vertical axes. The thickness of each roller usually amounts only to a fractional part of the diameter of the roller so that space is saved.

DETAILED DESCRIPTION OF THE PREFERRED EMBODIMENTS

Figure 1:
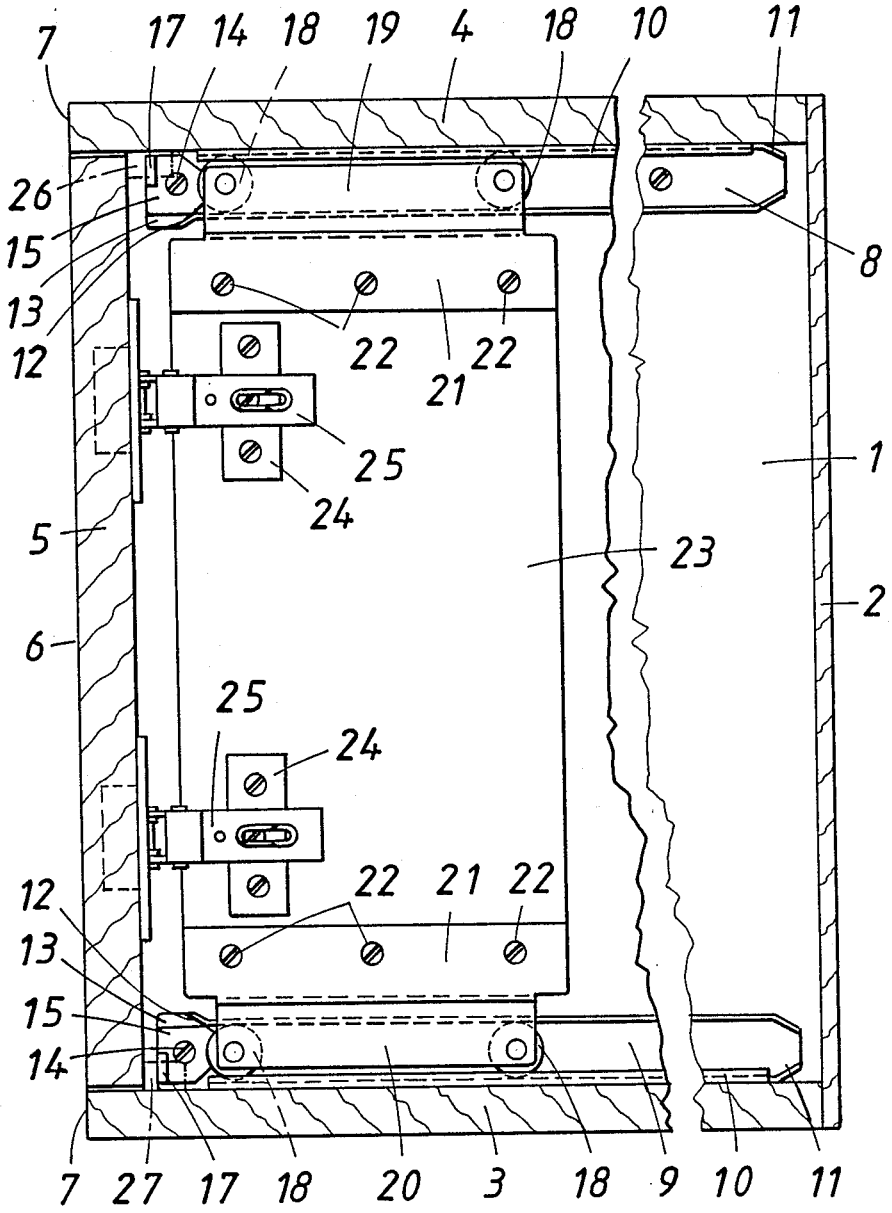
FIG. 1 is a longitudinal sectional view which is taken on a plane that is at right angles to the door plane, and shows a boxlike unit of furniture or furniture part with the door in a closed position.
Figure 2:
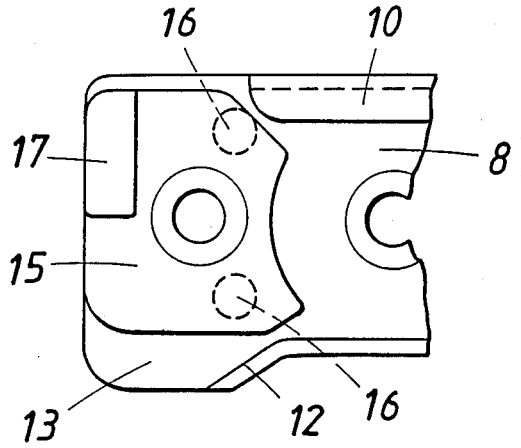
FIG. 2 shows the forward end of a track rail with a stop.
Figure 3:
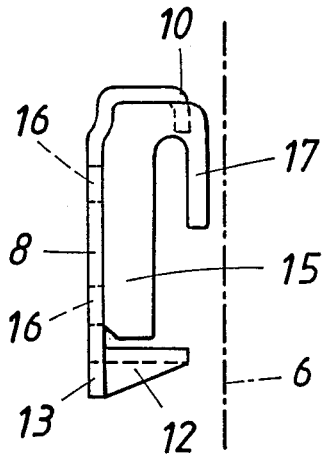
FIG. 3 is a side elevation related to FIG. 2 with the outside contour of the open door indicated in phantom.

Illustrative embodiments of the invention are shown on the drawing.

The unit of furniture shown on the drawing comprises side walls 1, a rear wall 2, a bottom 3 and a top 4.

In the embodiment shown in FIGS. 1 to 4, a hinged and sliding door 5 is provided to close the open side of the box. In the present embodiment, that door has a normally exposed surface 6 having edges which are aligned with the edges 7 of the bottom 3, top 4 and side walls 1 when the door is closed and in other embodiments may slightly protrude or be set back from said edges 7.

The door 5 is mounted on the box by a set of hardware comprising two track rails 8, 9, which are secured to the side wall 1 near its top and bottom edges, respectively, and have flanges which constitute bearing surfaces. One flange 10 is reversely bent to form a trough and embraces the associated rollers, which will be mentioned hereinafter. The other flange may be angled. Inturned stops 11 which are integral with the flanges, are provided at the rear ends of the rails 8, 9. The forward end portions of the flanges of the upper and lower rails 8, 9 are formed with cutouts which are mirror images of each other. One flange constitutes a run-up surface 12 and the material of said flange has been flattened to form an enlarged head 13. Adjacent to that head, a stop member 15 is secured by means of a screw 14. The stop member 15 has two extensions 16, which extend into mating openings of the head portion 13 of the rail to hold the stop member 15 in position. That side of the stop member 15 which faces in the longitudinal direction of the rail 8 or 9 is concavely curved. Each stop member 15 is integrally formed with a stop lug 17, which protrudes inwardly beyond the rail profile.

In the embodiment shown, two rollers 18 of a carriage 19 or 20 are inserted into each of the track rails 8, 9. A portion of each of the upper and lower carriages 19 and 20 is offset from the rollers 18 and from the wall 1 to constitute a retaining bar 21. By means of screws 22, a mounting plate 23 which covers the space between the two carriages 19, 20 is secured to the retaining bar 21. The base members 24 of two furniture hinges which are adjustable in three dimensions, are secured to said mounting plate and connect the door 5 to the mounting plate. From the closed position shown in FIG. 1, the door 5 can be swung open about a vertical axis defined by the furniture hinges 25 to a position in alignment with the mounting plate 23 and when the door is in that aligned position the door and the mounting plate can be pushed into the box in unison in a direction which is parallel to the side wall 1. The portions 17 of the stop members 15 constitute guards or guides, which prevent a scratching of the rails 8, 9 on the normally exposed surface 6 of the door 5.

Stops 26, 27 for cooperating with the closed door 5 are secured to the bottom 3 and to the top 4. Said closed position stops are mounted near the side walls, and the distance from the side wall 1 is so selected that the stops 26 and 27 will not prevent the inward sliding movement of the door 5 but will prevent or limit a fluttering of the door when it has been opened and pushed inwardly.

Figure 4:
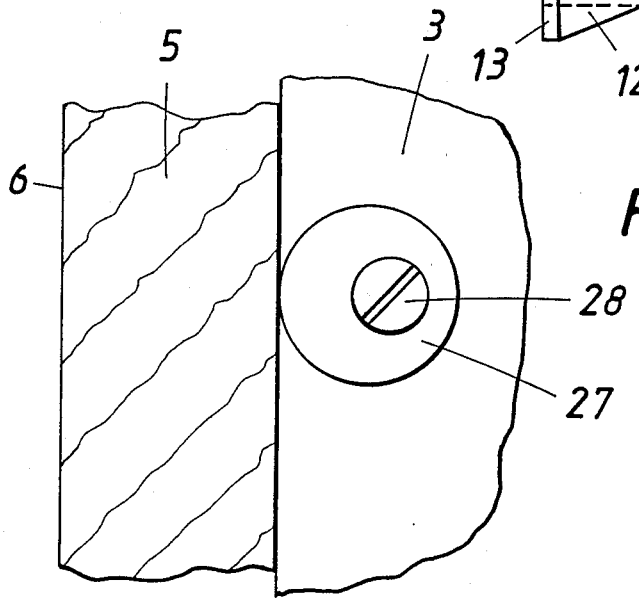
FIG. 4 is an enlarged top plan view showing a stop that is secured to the bottom of the box furniture and serves to cooperate with the door.

It is apparent from FIG. 4 that the closed-position stop 27 (this applies also to the closed-position stop 26) consists of an eccentric disc made of a yieldable material, such as plastic. The disc 27 is rotatable about a fixing screw 28 and the screw 28 can be tightened to fix the disc 27 in any desired angular position so that a fine adjustment of said stop is permitted.

Figure 5:
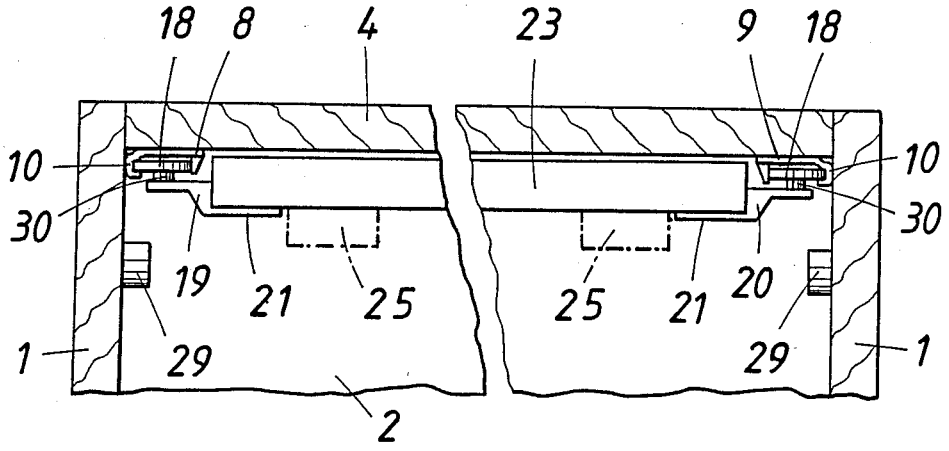
FIG. 5 is a diagrammatic view showing a boxlike unit of furniture that is provided with a door that can be swung open.

In the embodiment shown in FIG. 5 the door, not illustrated, is mounted to be swung open upwardly. For this purpose the track rails 8, 9 are secured to the top 4 of the box at the corners between said top and the side walls 1. The troughlike flanges 10 which receive the rollers 18 are in contact with the side walls 1. The carriages 19, 20 in which the rollers 18 are mounted comprise retaining members 21, which are interconnected by means of a mounting plate or another crosspiece 23. Only the contours of the furniture hinges 25 have been shown. Adjustable eccentric stops 29 for cooperation with the door are also provided. An essential feature of the embodiment shown in FIG. 5 resides in that the rollers 18 rotate about vertical axes 30 so that much space is saved. The troughlike flanges 10 receive only the rims of the rollers 18 so that the rollers actually roll rather than merely slide in the rails 8, 9.

I claim:

1. A set of hardware for mounting a hinged and slidable door on a box unit of furniture having an open side to be closed by said door and a wall which extends perpendicularly to said open side and has two spaced apart parallel horizontal edge portions, which set comprises hinge means adapted to define a hinge axis and to mount said door at one edge thereof for rotation about said axis from a closed position over said open side to an open position in which said door extends out of said box and is parallel to said wall, said door having two further edges extending from said one edge perpendicularly thereto, and slide track means adapted to be mounted on said wall so as to extend parallel thereto and to guide said hinge means and said door mounted on said hinge means into said box unit when said door is in said open position, wherein the improvement comprises two track rails constituting said slide track means and having respective bearing surfaces, the track rails being adapted to be secured to said two spaced apart parallel horizontal edge portions so that said bearing surfaces extend along said edge portions, two carriages adapted to be associated with respective ones of said track rails and each of which comprises at least two rollers adapted to roll on the bearing surface of the associated track rail, each carriage being provided with a bracket bent out toward the side facing away from the rollers, a mounting plate adapted to be secured to said brackets, to interconnect said carriages and to extend on that side of said carriages which is opposite to said wall, and further adapted to carry adjustable furniture hinges which constitute said hinge means and permit said door to be rotated to an open position in which said door is aligned with said mounting plate, carriage stop means adapted to limit the movement of said carriages along said track rails, and adjustable door stop means adapted to be mounted for cooperation with said additional edges of said door in said closed position.

2. The improvement set forth in claim 1 as applied to a set of hardware for mounting said door on a top wall of said box for rotation about a horizontal hinge axis defined by said hinge means, wherein said track rails have troughlike flanges and said rollers are adapted to be mounted for rotation about vertical axes and have rims extending into said troughlike flanges.

3. The improvement set forth in claim 1, wherein said carriage stop means comprise stop members made of yieldable material and adapted to be inserted into said track rails adjacent to said open side and adapted to cooperate with the adjacent rollers of said carriages, and said stop members carry guard means, which are adapted to protrude transversely beyond said rails and to cooperate with said door.

4. The improvement set forth in claim 3, wherein said stop members consist of plastic.

5. The improvement set forth in claim 1, wherein said door stop means comprise eccentric members, which are adapted to be secured to said box adjacent to said open side and are adjustable and adapted to be fixed in position.

6. The improvement set forth in claim 5, wherein said eccentric elements consist of resiliently yieldable material.

7. In a unit of furniture comprising a box having an open side and a wall which extends perpendicularly to said open side and has two spaced apart parallel horizontal edge portions, a hinged and slidable door for closing said open side, and hardware for mounting said door on said box, which hardware comprises hinge means defining a hinge axis and mounting said door at one edge thereof for rotation about said axis from a closed position over said open side to an open position in which said door extends out of said box and is parallel to said wall, said door having two further edges extending from said one edge perpendicularly thereto, and slide track means mounted on said wall and extending parallel thereto to guide said hinge means and said door mounted on said hinge means into said box when said door is in said open position, wherein the improvement comprises two track rails constituting said slide track means and having respective bearing surfaces, the track rails being secured to said two spaced apart parallel horizontal edge portions so that said bearing surfaces extend along said edge portions, two carriages associated with respective ones of said track rails and each of which comprises at least two rollers in contact with the bearing surface of the associated track rail, each carriage being provided with a bracket bent out toward the side facing away from the rollers, a mounting plate secured to said brackets interconnecting said carriages and extending on that side of said carriages which is opposite to said wall, adjustable furniture hinges constituting said hinge means and mounted on said mounting plate to permit said door to be rotated to an open position in which said door is aligned with said mounting plate, carriage stop means for limiting the movement of said carriages along said track rails, and adjustable door stop means mounted for cooperation with said additional edges of said door in said closed position.

* * * * *